US010728964B2

(12) United States Patent
Hauser et al.

(10) Patent No.: US 10,728,964 B2
(45) Date of Patent: Jul. 28, 2020

(54) COLOR TEMPERATURE CONTROL OF FLASH UNITS

(75) Inventors: Hans-Peter Hauser, Rheinfelden (CH); Marcel Griessmann, Steinbach (FR); Martin Buser, Basel (CH); Urs Zeltner, Rodersdorf (CH)

(73) Assignee: Bron Elektronik AG, Allschwil (CH)

( * ) Notice: Subject to any disclaimer, the term of this patent is extended or adjusted under 35 U.S.C. 154(b) by 1359 days.

(21) Appl. No.: 12/676,980

(22) PCT Filed: Sep. 9, 2008
(Under 37 CFR 1.47)

(86) PCT No.: PCT/EP2008/061896
§ 371 (c)(1),
(2), (4) Date: Oct. 12, 2011

(87) PCT Pub. No.: WO2009/034065
PCT Pub. Date: Mar. 19, 2009

(65) Prior Publication Data

US 2012/0112658 A1 May 10, 2012

(30) Foreign Application Priority Data

Sep. 10, 2007 (DE) ..... 10 2007 043 093

(51) Int. Cl.
*H05B 41/30* (2006.01)
*H05B 41/34* (2006.01)
(Continued)

(52) U.S. Cl.
CPC ..... *H05B 41/325* (2013.01)

(58) Field of Classification Search
CPC ..... H05B 41/32; H05B 41/34; H05B 41/30; H05B 41/325; H05B 37/02; H05B 37/0281
(Continued)

(56) References Cited

U.S. PATENT DOCUMENTS 3,590,314 A * 6/1971 Krusche ..... H05B 41/325 315/382
4,164,686 A 8/1979 Vital et al.
(Continued)

FOREIGN PATENT DOCUMENTS

DE 4125322 A1 2/1993
DE 10236636 A1 2/2004
(Continued)

OTHER PUBLICATIONS

PCT/EP2008/061896 International Search Report and Written Opinion dated Dec. 4, 2008 (14 pages).
(Continued)

*Primary Examiner* — Henry Luong
(74) *Attorney, Agent, or Firm* — Michael Best & Friedrich LLP

(57) ABSTRACT

A flash unit that includes a flash generator having at least one energy storage element and at least two light source channels as well as having at least two flash tubes, the flash tubes being supplied with energy by the energy storage element by means of the light source channels. The flash unit further includes an energy quantity control device, by means of which it is possible to provide for each light source channel any desired energy quantity from a minimum charge to a maximum charge of the at least one energy storage element, and a color temperature control device, by means of which it is possible to set a color temperature for each light source channel independently of the energy quantity provided therefor. The functions of all light source channels are fully equivalent.

22 Claims, 7 Drawing Sheets

(51) Int. Cl.
*H05B 45/10* (2020.01)
*H05B 45/20* (2020.01)
*H05B 41/32* (2006.01)

(58) Field of Classification Search
USPC ..... 315/291, 241 S, 241 P, 360; 348/224.1, 348/371, FOR. 201, E9.051
See application file for complete search history.

(56) References Cited

U.S. PATENT DOCUMENTS

| | | | | |
|---|---|---|---|---|
| 4,287,453 | A * | 9/1981 | Orban | H05B 41/325 250/214 SF |
| 4,485,336 | A * | 11/1984 | Yoshiyama et al. | 315/241 P |
| 4,853,600 | A | 8/1989 | Zeltner et al. | |
| 5,118,995 | A | 6/1992 | Hauser | |
| 5,485,201 | A * | 1/1996 | Aoki | G03B 7/16 348/223.1 |
| 5,815,204 | A | 9/1998 | Tetsuya et al. | |
| 5,895,128 | A | 4/1999 | Kishimoto et al. | |
| 5,896,014 | A * | 4/1999 | Ogawa et al. | 315/241 P |
| 8,634,021 | B2 * | 1/2014 | Kawakami | G03B 15/05 348/223.1 |

FOREIGN PATENT DOCUMENTS

| | | |
|---|---|---|
| GB | 2306812 | 5/1997 |
| JP | 58149033 | 5/1983 |
| JP | 58149033 | 9/1983 |
| JP | 62259393 | 11/1987 |
| JP | 06308586 | 4/1994 |

OTHER PUBLICATIONS

The Statement Accompanying the Article 19 Amendment dated Feb. 2, 2009 including English Translation (6 pages).
Office Action from the Japanese Patent Office for Application No. 2010-523531 dated Dec. 11, 2012 (Original and English Translation, 5 pages).
Office Action for Japanese Patent Application No. 2010-523531 dated Jul. 9, 2013 (2 pages).
European Examination Report from the European Patent Office for Application No. 08803864.1 dated Mar. 11, 2014 (6 pages).
German Patent Office Action for Application No. 102007043093.2 dated Jun. 29, 2018, 11 pages.

* cited by examiner

COLOR TEMPERATURE CONTROL OF FLASH UNITS

RELATED APPLICATIONS

This is a national phase application under 35 U.S.C. § 371 of International Patent Application No. PCT/EP2008/061896, filed on Sep. 9, 2008, which claims priority to German Patent Application No. 10 2007 043 093.2, filed on Sep. 10, 2007, the entire contents of both of which are incorporated herein by reference.

BACKGROUND

The invention relates to a flash unit and to a method of controlling flash units.

In photography, flash units have already long been used for uniformly illuminating a subject independently of the external light conditions, there being ignited in a flash tube a flash in which an energy store discharges. It is still relatively simple to control the brightness by means of the amount of light emitted as a whole during the flash. The relatively high energy required for that purpose can be set by charging the capacitors of the energy store to a correspondingly high degree.

SUMMARY

Brightness is not the only determining factor for image quality, however; trueness of color also plays an important role. In this connection the so-called color temperature has become established as a measure. In physical terms, the color temperature is defined by means of the integral of the intensity distribution (Planck distribution) of the black body radiation. If, therefore, a light source has, for example, a color temperature of 5000 K, the best black body model for its radiation intensity is that of a black body of 5000 K.

An illustrative indication of color temperature is offered by the comparison that ordinary daylight having a color temperature of about 6500 K also corresponds approximately to the surface temperature of the sun. Higher color temperatures have higher energy and are shifted towards blueish, while lower color temperatures are correspondingly red-shifted.

FIG. 6 shows, in diagrammatic form, the variation with time of the color temperature of a flash discharge. Shortly after the flash has been ignited, the output in the arc and thus also the color temperature reaches its maximum and then, following the characteristic of the capacitor in the energy store, falls exponentially to lower outputs and reddish color temperatures. If, as is usual, the entire time interval of the flash discharge shown in FIG. 6 is also smaller than the exposure time, the light-sensitive recording element is ultimately exposed with the color temperature averaged over time, for example an average of 5500 K.

FIG. 7 illustrates the problem of a lack of color constancy when the amount of light is controlled solely by means of the output of the energy store. The variation with time of the color temperature of a flash discharge having high energy and having low energy is shown superimposed. It will readily be seen that the average color temperature of the flash discharge having low energy results in a significantly reduced average color temperature. The color temperature is therefore dependent upon the flash energy selected, which is undesirable in use. That effect can also occur when the flash is triggered again before the energy store has been fully recharged.

FIG. 8 shows a method of correcting that undesirable side-effect in which the variation with time of the color temperature of a relatively low-energy flash discharge nevertheless results in the same average color temperature as a discharging operation at full energy. The idea lies in compensating for the blueish light components eliminated on account of the relatively low initial output to a suitable extent by eliminating yellowish and reddish components. For that purpose, the flash discharge is stopped prematurely by means of an output switch in the discharge circuit (flash cut-off technique). By a suitable choice of the combination of flash voltage and cut-off timepoint it is accordingly possible for the color temperature to be kept constant or also to be set freely, independently of the flash energy selected.

On the basis of the flash cut-off technique mentioned above it is possible to achieve good color temperature stability or regulation. An example of such a flash generator or such a flash unit is known from EP 0 240 789 A1 (corresponding U.S. Pat. No. 4,853,600). In the subject of EP 0 240 789 A1, for good color temperature stability or regulation simultaneous control of the flash time and the flash voltage is provided, which enables the color temperature to be kept constant or to be controlled.

Despite their good color temperature stability or regulation, however, multi-channel flash units based on that technique are subject to certain limitations. The flash on a second light source channel, which is connected to a second flash tube, can be controlled only to a limited extent with regulated color temperature, because the voltage of the second channel is predetermined by the first light source channel having the first flash tube. If the flash durations are the same for channels 1 and 2, the color temperatures are exactly identical. If the flash durations are different, however, the flash from channel 2 acquires a higher color temperature. For the user of the unit, usable color deviation tolerances can be adhered to only as long as the flash duration does not fall below a minimum. That situation has the result that on account of the common denominator of voltage in combination with constant color temperature only a limited asymmetry is possible. The limitation currently is about three stops and forms the main characteristic of the prior art. If that technique is used in combination with a channel that is not switched off, it is essential that the channel not switched off produces the greater flash. That represents an undesirable limitation of use.

Alternatively to the above-mentioned prior art there is also the technique of capacitor switching. The capacitor switching method likewise exhibits limits in the asymmetry. For economic reasons, only a limited number of capacitors are provided in the corresponding units. This results in a limited asymmetry. For example, for this purpose in the case of a minimum two-channel unit the stop value:

$$b=[\mathrm{int}(\log_2(n))]-1 \text{ is obtained,}$$

where n is the number of capacitors in circuit.

Using that technique, the asymmetry is limited to three stops, although 16 capacitors are used. The same technique results in further limitations such as, for example, relative limitations from light source channel to light source channel. In particular, that technique results in limitations in the asymmetry in the form of fixed energy distributions. The asymmetry is generally adjustable only in large steps on account of the block switchings of capacitors. In the case of a unit having two light source channels, for example, the following energy distributions are possible:

channel 1 with 40 percent, channel 2 with 60 percent, or
channel 1 with 30 percent, channel 2 with 70 percent, or
channel 1 with 20 percent, channel 2 with 80 percent.

Units which offer intermediate steps achieve this by means of a reduction in the flash voltage. That involves a lowering of the color temperature, which is again disadvantageous. This is shown in graph form as a color temperature characteristic curve in FIG. 9. Such a characteristic curve results in non-repeatability in the case of taking photographs, which are noticeable very especially in the case of photographs taken using digital cameras.

Units which have the above-described capacitor cut-off technique in some cases have capacitor block switching devices for coarse setting and other operating elements (for example a control knob) for finer setting. That means that the user (the photographer) needs to be familiar with the internal structure of the unit in order to be able to adjust the unit selectively. In addition, those units have the limitation that the total energy of the energy store is available only by means of the first and/or the second light source channel(s). The further light source channels have only limited possibilities. They can, for example, be supplied with only up to 50 percent or only up to 25 percent of the energy available to the generator.

Disadvantageously, therefore, unit-specific knowledge is needed for setting a suitable energy target distribution. An additional shortcoming of such systems is that the use or setting of the generator is dependent upon the number of flash tubes used, i.e. the number of light source channels occupied with flash tubes, which means in turn that the user has to acquire generator-specific knowledge in order to effect the desired settings.

Asymmetries and transpositions or inversions at the light source channels or the light sources also requires a change of connector at the generator. That is disadvantageous especially in professional studios where the generator is often mounted close to the light source (that is to say in particular on the ceiling).

In one embodiment, the present invention provides a flash generator which allows complete flexibility in use with any desired number of flash tubes controlled thereby, the user not requiring unit-specific knowledge for its operation or setting. A further problem is to define a method which enables the control of a flash unit to be handled with as few complications as possible.

One aspect of the invention is accordingly that a flash unit with a flash generator having at least one energy store and at least two light source channels as well as having at least two flash tubes, which are supplied with energy by the energy store by means of the light source channels, is provided with an energy quantity control device as well as with a color temperature control device. By means of the energy quantity control device, it is possible to provide for each light source channel any desired energy quantity from the minimum charge to the maximum charge of the at least one energy store. By means of the color temperature control device, it is possible to set a color temperature for each light source channel independently of the energy quantity provided therefor. The solution according to the invention provides the prerequisites for illuminating a subject with a plurality of flash tubes with individually selected color temperature and amount of light. This has the advantage of high flexibility and an optimum range of possible settings for the photographer.

In a preferred embodiment of a flash unit according to the invention, all light source channels are equivalent in respect of their function and their setting. The color temperature can be identical for all light source channels, while in a further preferred embodiment all light source channels are independent of one another and especially in respect of their function and/or the energy quantity provided therefor can be set separately from one another. If only some of the light source channels are equipped with light sources or flash tubes, the channels so equipped can preferably be freely selectable, because each channel offers exactly the same range of possible settings. By virtue of the above-mentioned structural features, the photographer is assured of an optimum result with, at the same time, convenient handling.

In a further preferred embodiment of a flash unit according to the invention there is provided a trigger device which at a preset timepoint supplies a first light source channel with energy and which at a further number of predetermined timepoints, which are defined by the voltage present at the first light source channel, supplies a respective predetermined number of light source channels with energy. The flash unit according to the invention is optionally equipped with a cut-off device which switches off the first and the further light source channel(s) when a predetermined target energy quantity and/or an averaged target color temperature has been reached for the respective light source channels. The target color temperature can especially be an averaged target color temperature. As a result of such structural measures (especially a trigger device and a cut-off device), an optimum image result is ensured.

Advantageously, there is provided a control means which is arranged to set the ignition and cut-off timepoints of each flash tube in such a way that each flash tube emits light of a preset color temperature averaged over the time of the flash discharge. With such a flash unit, the user therefore no longer has to rely on setting the ignition and cut-off timepoints but can work immediately with the more descriptive parameter of color temperature.

Preferably, here the preset color temperatures are identical. In this special embodiment, therefore, the further flash tubes serve for better illumination of the subject without color falsification.

Advantageously, the energy store has a plurality of rechargeable energy store elements, especially capacitors. As a result, the energy store can be used more flexibly and can also be used in the event of failure of one of the energy store elements.

Preferably, here the energy store is arranged to connect a plurality of the energy store elements to the flash tubes in parallel for the emission of more charge for a flash or sequentially for a plurality of successive flashes of the flash unit. It is thus possible for the amount of light to be used beyond the capacity of one of the energy store units or to be used a number of times in succession without the need for a charging operation, or naturally in a combination of the two possibilities.

Advantageously, a charging device for the energy store is provided which has a charging control means for introducing a preset charge into one or more of the energy store elements. It is thus possible to set the initial maximum output of the flash discharge and accordingly also the upper limit for the amount of light emitted.

The charging device for setting charging time, charging current and charging voltage can be constructed in such a way that the discharge of the energy store elements by means of the flash tubes produces a preset amount of light in a preset discharge time at a preset color temperature, it being necessary to note here that the charging device can preset only respective maximum values for the amount of light and the color temperature, because this naturally depends upon the ignition and cut-off timepoints. In any case, however, a corresponding charge state of the energy store elements is necessary in order to provide any scope at all for configuration of the later time-related control.

Advantageously, the energy store is housed in a generator and the flash tubes in a light source. The energy supply and the actual flash unit are thus separated from one another and are accordingly easier to transport and to maintain.

More advantageously, the time control means and the charging control means are housed in respective modules or in a common module and the generator and/or the light source has(have) a connection for the modules. Those control modules provide for a high degree of flexibility in that, for example, the modules can be interchanged without problems and can also be re-configured independently of the flash unit. This also renders the flash unit more flexible and easier to maintain.

Flash control can optionally be effected by means of a cut-off means or by means of a combination of an ignition delay means and a/the cut-off means. The flashes produced optionally are or are caused to be centered, superimposed or generated in series. This too provides an optimum image result.

In another embodiment the invention provides a method that relates to the control of a flash unit having at least one energy store and at least two light source channels as well as having at least two flash tubes, each associated with a respective light source channel, which are excited to emit light by the discharge of the energy store. One aspect of the method according to the invention is that any desired energy quantity is set for each flash discharge of each flash tube or each light source channel and that a color temperature is set for each flash discharge independently of the energy quantity provided therefor. The advantages are obtained analogously to the device according to the invention.

The flash unit can additionally have a third and/or further flash tube(s), the flash discharges of the third and/or further flash tube(s) being delayed in time with respect to that of the first flash tube, and the cut-off timepoint for the flash discharge of the third and/or further flash tube(s) being set independently of that of the first flash tube. It would equally be possible to set the ignition and cut-off timepoints of each flash tube so that each flash tube emits light of a preset color temperature averaged over the time of the flash discharge. In a preferred embodiment, the preset color temperatures are identical, while the flash discharges of the flash tubes are able to produce a preset amount of light in a preset discharge time at a preset color temperature.

The invention will be described below also in respect of further features and advantages on the basis of exemplary embodiments and referring to the accompanying drawings.

DETAILED DESCRIPTION

Figure 1:
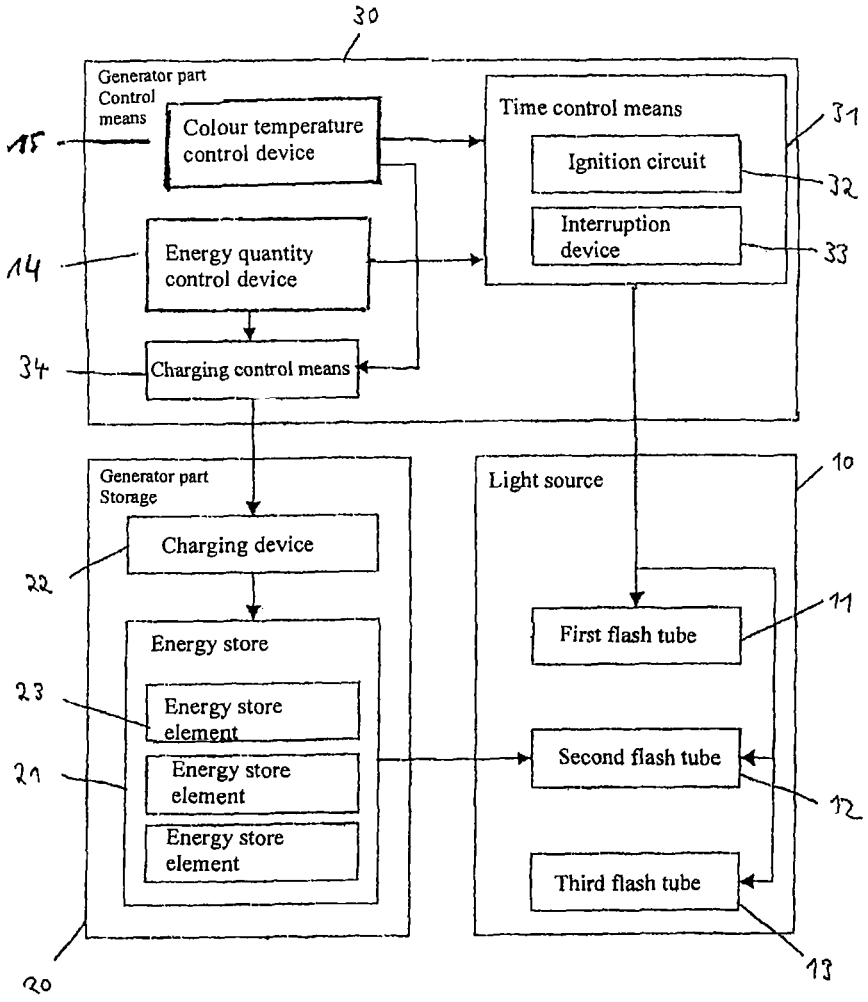
FIG. 1 shows an embodiment of the flash unit according to the invention.

FIG. 1 shows an embodiment of the flash unit 1 according to the invention. In a light source 10 of the flash apparatus 1 there are arranged a first, a second and a third flash tube 11-13 which can be, for example, xenon tubes. A generator 20 of the flash unit 1 has an energy store 21 in which energy store elements 23 can be charged with electrical energy by means of a charging device 22.

The flash unit 1 according to the invention also has an energy quantity control device 14 and a color temperature control device 15. By means of the energy quantity control device 14, any desired energy quantity from the minimum charge to the maximum charge of the energy store 21 can be provided individually for each light source channel, i.e. for each flash tube 11-13. By means of the color temperature control device 15, it is possible to set a color temperature for each light source channel, i.e. for each flash tube 11 to 13, independently of the energy quantity provided for the respective flash tube 11-13. An exemplary curve of the energy output quantities of the flash unit 1, i.e. of the flash generator 20, is shown in FIG. 2*a*. It should be mentioned at this point that all light source channels, that is to say therefore all channels for the flash tubes 11-13, are equivalent in respect of their function and their setting. Furthermore, they can be set independently of one another and, especially in respect of their function or the energy quantity provided therefor, separately from one another.

As energy store elements 23 there are used capacitors, the total capacity of an energy store element possibly being multiplied by parallel connection of a plurality of capacitors. The energy store 21 is connected to the flash tubes 11-13 in order to supply them with electrical energy for a flash discharge. The charging device 22 is capable of charging the energy store elements 23 with a preset charge, the charge in the energy store elements 23 being controllable by means of charging current, charging voltage and charging time. Handling is simplest when, at a preset charging voltage, the charging time is selected to be such that an equilibrium is able to develop.

The energy store 21 can be connected to the flash tubes 11-13 in such a way that only some of the energy store elements 23 feed the flash discharge. As a result, immediately after a flash discharge it is possible to trigger a further flash discharge with the aid of energy store elements not previously used. At the same time it is possible for discharged energy store elements 23 to be re-charged during a flash discharge that is being fed by other energy store elements 23.

In a control means 30 of the flash unit 1, the times of the flash discharge in the flash tubes 11-13 can be fixed by means of a time control means 31. For that purpose, the time control means 31 is provided with an ignition circuit 32 and a cut-off device in the form of an interruption device 33 which are each able to actuate each of the flash tubes 11-13 individually. The ignition circuit 32 can therefore make the connection between the energy store 21 and each individual flash tube 11-23, while the interruption device 33 interrupts that connection in order to extinguish the flash, the time control means 31 being arranged to calculate suitable ignition and cut-off timepoints for preset amounts of light and color temperatures.

A charging control means 34 of the control means 30 is connected to the charging device 22 of the generator 20. The charging control means 34 is capable of calculating the above-mentioned charging parameters of the charging device 22 for the desired maximum amount of light.

Figure 2:
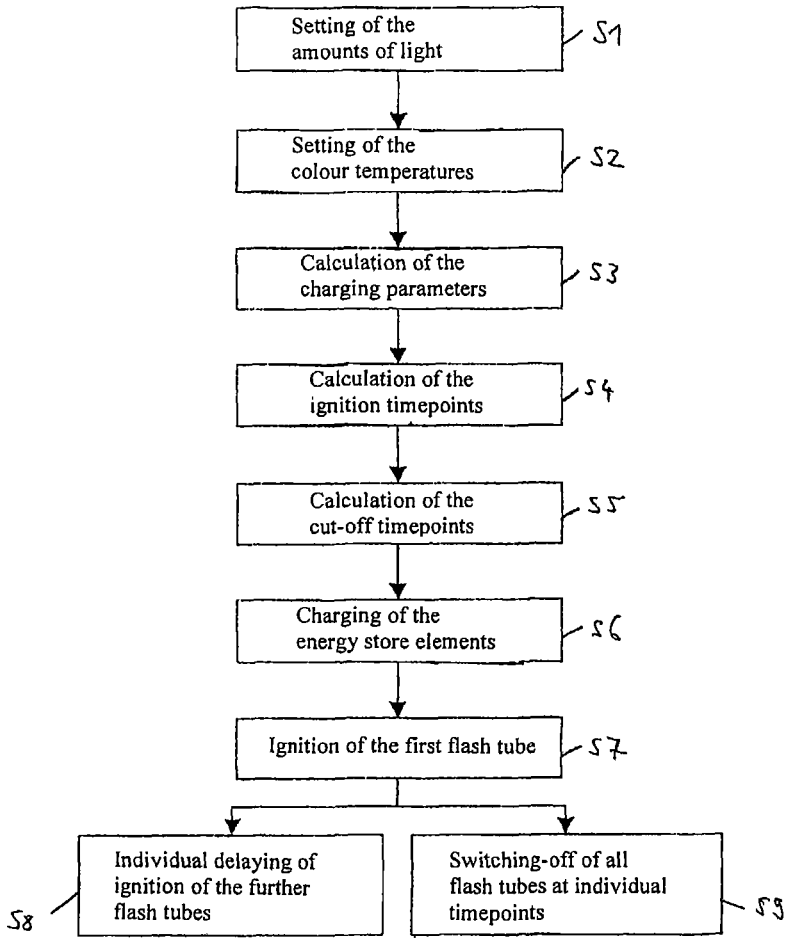
FIG. 2 shows an embodiment of the method according to the invention for controlling a flash unit, for example in accordance with FIG. 1.
Figure 2A:
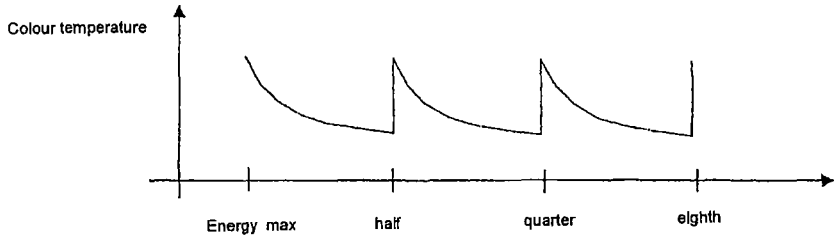
FIG. 2*a* shows the variation with time of the output energy of the flash unit according to the invention for different light source channels.

The function of the described flash unit 1 will now be explained on the basis of a description of the method according to the invention, as shown in FIG. 2. If, first of all, the flash parameters are to be set, in a first step S1 the desired energy quantities or amounts of light are fixed individually for each flash tube 11-13. That can be effected by a user, but also automatically, for example, taking into account the external light conditions detected by sensors. In a next step S2, the desired color temperatures for each individual flash tube 11-13 are set by the user or automatically in a corresponding way.

In a third step S3, the charging control means 34 calculates the charging parameters for the charging device 22 on the basis of the desired amounts of light and color temperatures. In steps S4 and S5, the time control means 31 calculates the individual ignition and cut-off timepoints of each individual flash tube 11-13, the cut-off timepoints of the second and third flash tubes being calculated as a delay with respect to the first flash tube. The first flash tube therefore forms the time reference point which is determined, for example, by the triggering of a photograph.

The control means 30 has now been set ready for the use of the flash unit 1. It will be understood that the setting of the parameters need not be carried out afresh for each flash. Instead, the flash unit can be used with the parameters now calculated for as long as desired and for any desired number of flashes. It would also be possible for the control means 30 to be of substantially simpler construction and to have no capability at all for actually calculating the flash parameters on the basis of the total amount of light and the color temperature. In that case, there are simply provided a plurality of schemes for charging voltage and ignition and cut-off timepoints. The user can then make a selection from those fixed schemes, which can also be selected by more illustrative names (for example "daylight, bright") than by fixing the physical parameters of amount of light and color temperature.

In a further step S6, which in the case of the fixed preset parameter scheme can also be the first step, the energy store elements 23 in the energy store 21 are charged by the charging device 22. From that moment on, the flash unit is ready for use and when a flash is triggered, the first flash tube is ignited, step S7.

From that timepoint on, the time control means 31 simultaneously monitors whether the delay interval for the ignition of a further flash tube 11, 12 has elapsed since the ignition of the first flash tube. In that case, the further flash tube 11, 12 is also ignited. At the same time, all flash tubes are monitored as to whether the cut-off timepoint has been reached and therefore the connection to the energy store 21 of the flash tube 11-13 in question has to be interrupted in order to extinguish the flash.

For further use of the flash unit 1, the cycle is repeated either using the same flash parameters in step S6 with the charging of the energy store elements 23 and possibly with the use of other, still charged store elements 23, or using modified flash parameters with the amounts of light and color temperatures being set afresh.

Figure 3:
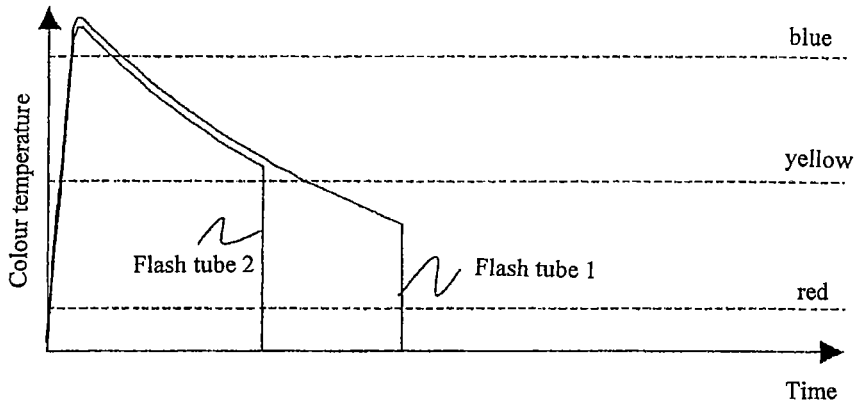
FIG. 3 shows the variation with time of the color temperature of a flash discharge in a flash unit according to the invention in an especially simple configuration of the ignition and cut-off timepoints.
Figure 4:
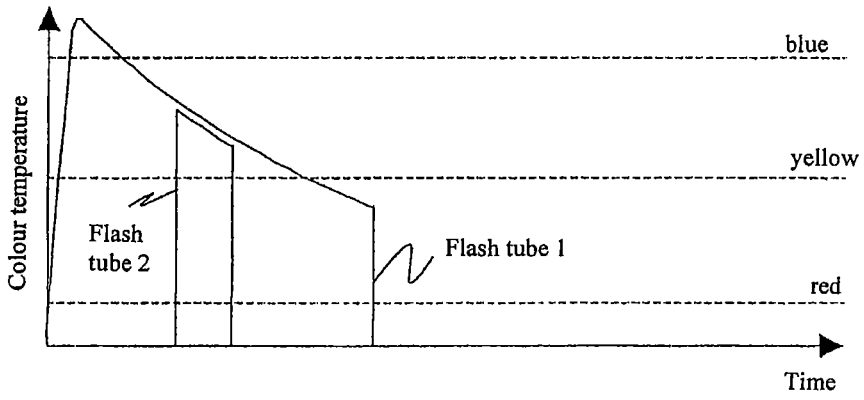
FIG. 4 shows the variation with time of the color temperature of a flash discharge in a flash unit according to the invention in which the color temperatures of the individual flash tubes are identical to one another.
Figure 5:
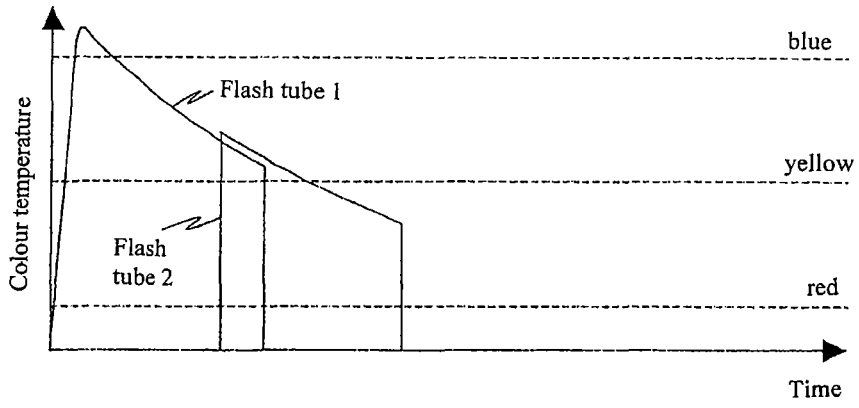
FIG. 5 shows the variation with time of the color temperature of a flash discharge in a flash unit according to the invention in which the color temperature of one flash tube is deliberately selected to be different from that of the other flash tube.
Figure 6:
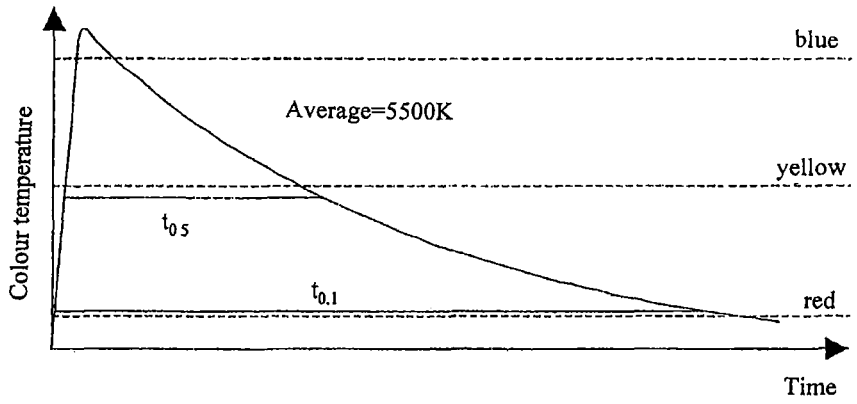
FIG. 6 is a general diagram illustrating the variation with time of the color temperature in the case of a flash discharge.
Figure 7:
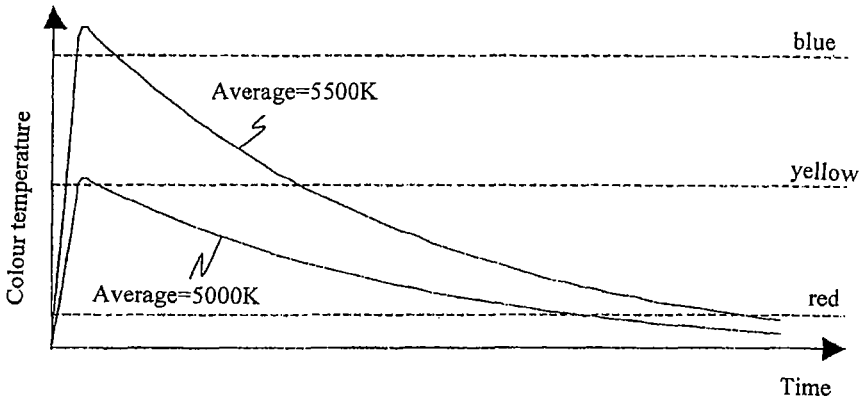
FIG. 7 shows, superimposed, the variation with time of the color temperature of two flash discharges which result in different average color temperatures.
Figure 8:
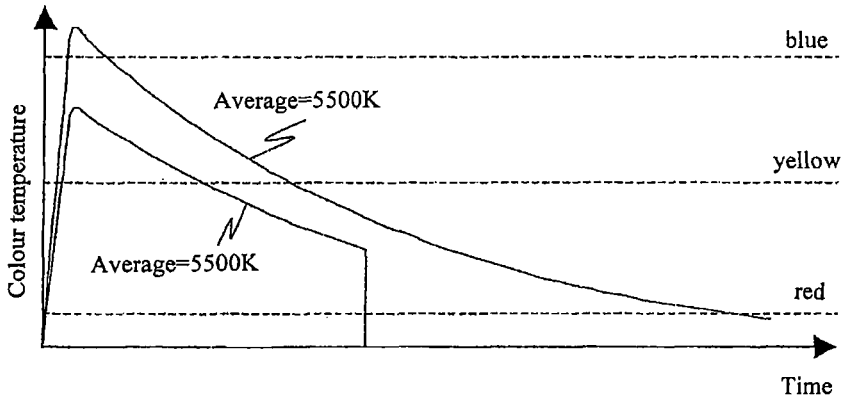
FIG. 8 is a diagram in accordance with FIG. 7, in which the average color temperature of one flash discharge has been compensated using a conventional method.
Figure 9:
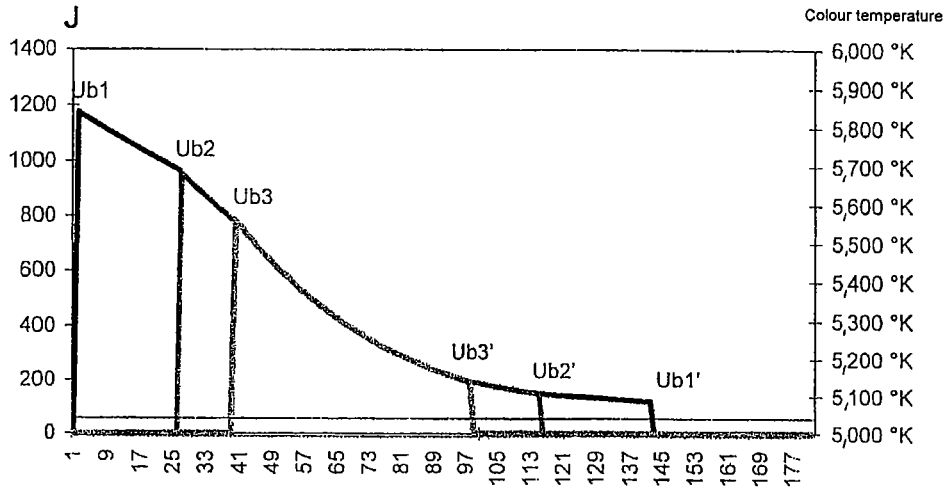
FIG. 9 is a diagram showing the energy curve at the energy store during a flash operation.

FIGS. 3 to 5 show, in diagrammatic form, various application scenarios of the flash unit 1 according to the invention. The Figures show, superimposed, the variation with time of the color temperatures of two flash tubes, only two flash tubes being shown here for the purpose of simplification. FIG. 3 shows the simplest case, in which the flash tube 2 is merely switched off with a delay with respect to the flash tube 1. This has the result that the flash tube 2 emits a larger amount of light but that at the same time, on account of the higher yellow components, the flash tube 2 has a lower color temperature than the flash tube 1.

In FIG. 4, however, the ignition timepoint of the flash tube 2 is delayed with respect to the flash tube 1 and at the same time the cut-off timepoint is selected to be early so that the average of the color temperature of the two flash tubes over time is identical, the flash tube 2, in accordance with the substantially smaller area in FIG. 4, emitting a smaller amount of light.

FIG. 5 shows that according to the invention it is also possible, with a delayed ignition timepoint of the flash tube 2, deliberately to select a different average color temperature with respect to the flash tube 1.

The flash unit according to the invention therefore enables the brightness and color temperature of a plurality of flash tubes to be selected individually.

In summary, it can be stated that the flash unit according to the invention is capable of delivering any desired energy level to any desired light source channel, i.e. to any desired flash tube. With this unit structure it is possible to deliver the total energy of the energy store 21 by means of any light source channel. It is also possible to set for the respective light source channels an energy quantity between 0 and 100 percent of the energy available in the energy store 21 or the flash generator 20, independently of the values set in the secondary channels, it being understood that the sum of the values set over the channels may not be greater than the energy available in the energy store 21. In addition, the energies are so controlled (current curve, voltage curve and variation with time) that the resultant flashes have the same color temperature from channel to channel. At the same time, for each light source channel the color temperature can be regulated and set independently of the energy quantity selected for the flash. This has the advantage inter alia that the light source connectors no longer have to be exchanged when an asymmetry is to be, for example, reversed or inverted. This saves time and difficult handling for the user. A further advantage is that the operation of such a flash generator 20, i.e. such a flash unit 1, does not require specific knowledge or understanding of the generator structure. That is especially of advantage in the case of hire businesses where the simplicity allows easy initial set-up and where the hire time is being paid for. With this structure there are no limitations or internal conditions which have to be taken into consideration during setting. Because the functions of all light source channels are fully equivalent, any channel can be connected without other light sources or flash tubes being connected.

Asymmetries can be simply inverted by means of push-button selection, without the need to manipulate light source cables or to operate a plurality of operating elements. That flexibility can be achieved by selecting the voltage ranges of the flashes to be generated in such a way that the energy quantity supplied to the flash tube at those voltages produces a color temperature that is constant or has a selected value. To implement the method it is necessary that, during the first flash (blue when the precalculated voltage Ub2 has been reached (see in this connection FIG. 2*a*)), the second flash be triggered voltage-shifted. Accordingly, the third flash is likewise triggered when the voltage Ub3 has been reached. When Ub3 has been reached, the flash operation is active on three channels. That operation or that method can also be used for a higher number of channels.

The end of the flash is controlled in accordance with a flash cut-off operation, it being necessary to note that that alone does not allow the same color temperature to be reached. The method according to the invention has the advantage of theoretically unlimited asymmetry. The prior art of three stops becomes theoretically unlimited and depends only upon the implementation quality or accuracy. The color temperature can be regulated channel-specifically. At the same time, the energy quantity can be freely determined for each channel.

With the multi-channel flash units according to the invention it is therefore possible for a plurality of flashes to be produced simultaneously, that is to say with at least one superimposition of the flashes (in a photographic sense).

Although the invention has been described on the basis of the above-mentioned exemplary embodiments, it also comprises further advantageous combinations of the mentioned features.

We claim:

1. A flash unit comprising:

a flash generator having at least one energy storage element and at least two light source channels as well as having at least two flash tubes, the at least two flash tubes being supplied with energy by the at least one energy storage element via the light source channels;

an energy quantity control device configured to supply said each light source channel any desired energy quantity from a minimum charge to a maximum charge of the at least one energy storage element; and a color temperature control device configured to vary an average emitted color temperature for said each light source channel independently of the energy quantity supplied for said each light source channel by independently controlling times of flash discharges of the at least two flash tubes, wherein functions of the at least two light source channels being fully equivalent.

2. The flash unit according to claim 1, wherein the at least two light source channels are equivalent in respect of their function and their setting.

3. The flash unit according to claim 1, wherein the average emitted color temperature is identical for the at least two light source channels.

4. The flash unit according to claim 1, wherein the at least two light source channels are at least one of independent of one another with respect to their function and the energy quantity supplied therefor can be set separately from one another.

5. The flash unit according to claim 1, wherein the at least two light source channels are freely selectable.

6. The flash unit according to claim 1, further comprising a trigger device which at a preset timepoint supplies a first light source channel with energy and which at a further number of predetermined timepoints, which are defined by a voltage present at the first light source channel, supplies a respective predetermined number of light source channels with energy.

7. The flash unit according to claim 6, further comprising a cut-off device which switches off respective light source when at least one of a predetermined target energy quantity and a target color temperature has been reached for the respective predetermined number of light source channels.

8. The flash unit according to claim 1, wherein the at least one energy storage element includes a plurality of rechargeable energy storage elements.

9. The flash unit according to claim 8, wherein the plurality of rechargeable energy storage elements connect to the at least two flash tubes in at least one of in parallel for the emission of more charge for a flash and sequentially for a plurality of successive flashes of the flash unit.

10. The flash unit according to claim 8, further comprising a charging device for the energy storage element which has a charging control means for introducing a preset charge into one or more of the plurality of rechargeable energy storage elements.

11. The flash unit according to claim 10, wherein the charging device is configured to set charging time, charging current and charging voltage in such a way that a discharge of the plurality of rechargeable energy storage elements by means of the at least two flash tubes produces a preset amount of light in a preset discharge time at a preset color temperature.

12. The flash unit according to claim 1, wherein the energy storage element is housed in a generator and the at least two flash tubes in a light source.

13. The flash unit according to claim 12, further comprising a time control means and a charging control means, wherein the time control means and the charging control means are housed in at least one of respective modules and a common module and wherein at least one of the generator and the light source includes a connection for the at least one of the respective modules and the common module.

14. The flash unit according to claim 1, further comprising a flash control that is affected by means of a cut-off means.

15. The flash unit according to claim 14, wherein the flash control is affected by means of a combination of an ignition delay means and the cut-off means.

16. The flash unit according to claim 1, wherein flashes produced are caused to be at least one of centered, superimposed and generated in series.

17. A method of controlling a flash unit having at least one energy storage element and at least two light source channels as well as having at least two flash tubes, each associated with a respective light source channel, the method comprising:

discharging the at least one energy storage element;

exciting the at least two flash tubes to emit light to generate a respective flash discharge of each of the at least two flash tubes;

setting any desired energy quantity for each of the respective flash discharges of the at least two flash tubes; and varying an average emitted color temperature for each flash discharge independently of an energy quantity supplied for said each of the respective flash discharges by independently controlling times of the respective flash discharges, wherein functions of the at least two light source channels being fully equivalent.

18. The method according to claim 17, further comprising, providing a third flash tube;

delaying the respective flash discharge of the third flash tube in time with respect to that of at least one of the at least two flash tubes; and setting a cut-off timepoint for the respective flash discharge of the third flash tube independently of that of the at least two flash tubes.

19. The method according to claim 18, further comprising, setting ignition and the cut-off timepoint of each flash tube so that each flash tube emits light of a preset color temperature averaged over a time of the respective flash discharge.

20. The method according to claim 19, wherein the preset color temperatures are identical.

21. The method according to claim 17, further comprising, producing a preset amount of light in a preset discharge time at a preset color temperature with the respective flash discharges of the at least two flash tubes.

22. The method of claim 17, further comprising, producing the respective flash discharges such that the respective flash discharges are at least one of centered, superimposed and generated in series.

* * * * *